United States Patent [19]

Smith

[11] Patent Number: 4,583,302

[45] **Date of Patent: * Apr. 22, 1986**

[54] HELICAL DRYER BELT WITH PROFILED PERMEABILITY

[75] Inventor: Richard W. Smith, Greenville, S.C.

[73] Assignee: Wagner Systems Corporation, Greenville, S.C.

[ * ] Notice: The portion of the term of this patent subsequent to Jan. 1, 2002 has been disclaimed.

[21] Appl. No.: 667,904

[22] Filed: Nov. 2, 1984

Related U.S. Application Data

[63] Continuation-in-part of Ser. No. 502,255, Jun. 8, 1983, Pat. No. 4,490,925.

[51] Int. Cl.[4] ..... F26B 13/08

[52] U.S. Cl. ..... 34/116; 34/123; 34/243 R; 139/383 A; 474/260; 428/222

[58] Field of Search ..... 34/116, 123, 243 R; 139/383 A, 408, 411, 41 B; 428/259, 296, 222; 474/260, 264; 198/848, 851

[56] References Cited

U.S. PATENT DOCUMENTS 3,867,766 2/1975 Wagner ..... 34/71
4,381,612 5/1983 Shank ..... 34/123
4,490,925 1/1985 Smith ..... 34/123

*Primary Examiner*—Larry I. Schwartz
*Attorney, Agent, or Firm*—Cort Flint

[57] ABSTRACT

A non-woven helical dryer belt is illustrated having a desired permeability profile which includes lateral zones 42 and 44 of reduced permeability and a medial zone 46 of increased permeability. The helical drive belt is made by joining a number of helix strips (20) together lengthwise and having the helix strips extend crosswise the fabric. A base monofilament element (40) extends across the entire width of the drive belt to impart a base permeability characteristic to the fabric. At opposing lateral edges of the fabric, an edge filler strip is inserted which reduces the permeability of the fabric in the lateral zones (42, 44). The height of the base and edge monofilament elements is made such that they do not overlap one another and are maintained in their side by side arrangement in the lateral zones of reduced permeability. A contoured monofilament edge element (C) is also disclosed which produces a very low permeability in the lateral zones (42, 44) by incorporating contoured edges (60) which protrude into the crevice spaces of the winding spaces to more fully block the air flow in the lateral zones.

7 Claims, 7 Drawing Figures

HELICAL DRYER BELT WITH PROFILED PERMEABILITY

This application is a continuation-in-part of applicant's copending application Ser. No. 502,255 filed June 8, 1983, entitled LOW PERMEABILITY SPRIRAL FABRIC AND METHOD, now U.S. Pat. No. 4,490,925.

BACKGROUND OF THE INVENTION

In the process of making paper, an aqueous suspension of fibers is transformed into a paper web as it is processed through different sections of a paper making machine. One section of the paper making machine is the dryer section wherein a wet paper web is passes about and held in intimate heat transfer contact with upper and lower arrays of heated cylinders in order to remove the water from the paper web and dry it completely. The dryer section normally includes an upper and lower array of heated cylinders arranged and spaced in staggered, parallel rows which have a solid imperforate surface for contacting the paper web. The paper web passes between the arrays of dryer cylinders in a generally serpentine manner to ensure that both sides of the paper web contact the cylinders and dry evenly. As the paper web passes over the dryer cylinders, it is held in intimate heat transfer contact by a belt commonly known as a dryer belt or dryer fabric which has been made endless by techniques that are well known in the field of papermaking felts and clothing.

The heated cylinders of the dryer section are typically heated by steam introduced into the interior of the cylinders, by infrared radiation, or by other suitable means. However, in a lot of cases the temperature of the heated cylinder varies from one end to the other by a considerable amount. This creates the possibility that some portions of the paper web will be subjected to greater drying action than other portions of the paper web. The variance in the cylinder temperature and the drying action creates a non-uniform moisture profile in a paper web across the width of the web. Furthermore, it is known that the lateral edges of the paper web are more readily ventilated since they lie closer to the surrounding atmosphere and thus they tend to dry more quickly and more completely. This phenomenon is commonly known as rimming.

To eliminate the higher moisture in the center of the paper web, numerous methods and mechanical arrangements have been proposed. For example, mechanical corrections to the machinery have been implemented to try to avoid the uneven heating of the cylinders and non-uniform exposure of the paper web to the atmosphere. Proceeding in a different direction, the paper drying fabric itself has been designed to alleviate this problem by building in a desired permeability profile into the dryer fabric so that the resulting drying of the paper web is uniform across its width from one end of the heating cylinder to the other. For example, in U.S. Pat. No. 3,867,766 a woven dryer fabric is disclosed in which the number of warp elements at the lateral edges is varied to produce a desired permeability profile across the edges and the middle of the fabric. In U.S. Pat. No. 4,460,023 it is proposed to insert an additional pick of the weft yarn across the width of the fabric at the lateral edges of the fabric to reduce the permeability at the edges. The remainder of the pick across the width of the fabric is severed so that the pick of the weft yarn only exists at the lateral edges. While the above constructions are satisfactory for woven constructions, these fabrics and methods do not lend themselves readily to producing a profile permeability in non-woven dryer fabrics.

Helical dryer fabrics which include a number of helices joined together by intermeshing the windings of the helices and extending a pintle through the channel formed by the intermeshed windings have become increasingly in use as dryer fabrics. U.S. Pat. No. 4,381,612 discloses such a dryer fabric wherein monofilament stuffer elements are inserted through the winding spaces of the helices across the fabric width in order to cut down on the overall permeability of the fabric. Owing to the considerable openness of the helical mesh which exists in the fabric, the blocking of the fabric is necessary in many applications to avoid unnecessary pumping of air through the fabric and resultant paper flutter against the fabric. However, even in the use of a helical dryer fabric, the problem still exists of uneven temperatures across the width of the heating cylinders which results in uneven drying of the paper.

In U.S. Pat. No. 4,192,080 a method of improving the drying characteristics of a cylinder drying section of a paper making machine is disclosed which includes coating the rim areas of the outer jacket surface of at least some of the drying cylinders with a heat insulating foil.

Thus, while many mechanical expedients and fabric constructions have been proposed for woven fabrics, the provision of a non-woven helical dryer fabric having a desired permeability profile is a problem to which much attention need be given.

Accordingly, an important object of the present invention is to provide a non-woven, helical dryer belt having a desired permeability profile across the width of the fabric to produce uniform drying of a paper web in a paper making machine.

Still another important object of the present invention is to provide a dryer belt and method for providing a profile permeability characteristic in a paper making fabric so that a uniform moisture content across the width of a paper web being dried is obtained.

SUMMARY OF THE INVENTION

According to the present invention, the above objectives are accomplished by providing a non-woven helical dryer belt which includes a plurality of helix strips made from a thermoset synthetic polymeric material. The helix strips extend across the width of the fabric and are intermeshed with one another along the length of the fabric to provide a dryer belt of a desired length. The helix strip includes a plurality of windings which are opened through the width of the fabric. The open winding space defined within each of the windings is limited by the protrusion of the intermeshing bend portions of adjacent adjoining helix strips and the effective height of the open winding space is defined by the top and bottom runs of the windings. At the lateral edges of the helical fabric, a monofilament filler strip is inserted from each edge of the fabric toward a medial portion of the fabric. The monofilament filler strips terminate a desired distance away from the edges of the fabric to provide lateral zones of reduced permeability across the width of the fabric at each lateral edge. In a preferred embodiment, a base filler strip extends across the entire width of the fabric, and is arranged side by side with the edge filler strip.

BRIEF DESCRIPTION OF THE DRAWINGS

The construction designed to carry out the invention will hereinafter be described, together with other features thereof.

The invention will be more readily understood from a reading of the following specifications and by reference to the accompanying drawings forming a part thereof, wherein an example of the invention is shown and wherein.

DESCRIPTION OF A PREFERRED EMBODIMENT

The invention relates to a method and construction of a dryer belt fabric for a dryer section of a paper making machine. Since such paper making machines are well known in the art, only so much of a dryer section of a paper making machine as is necessary to an understanding of the invention will be illustrated.

Figure 1:
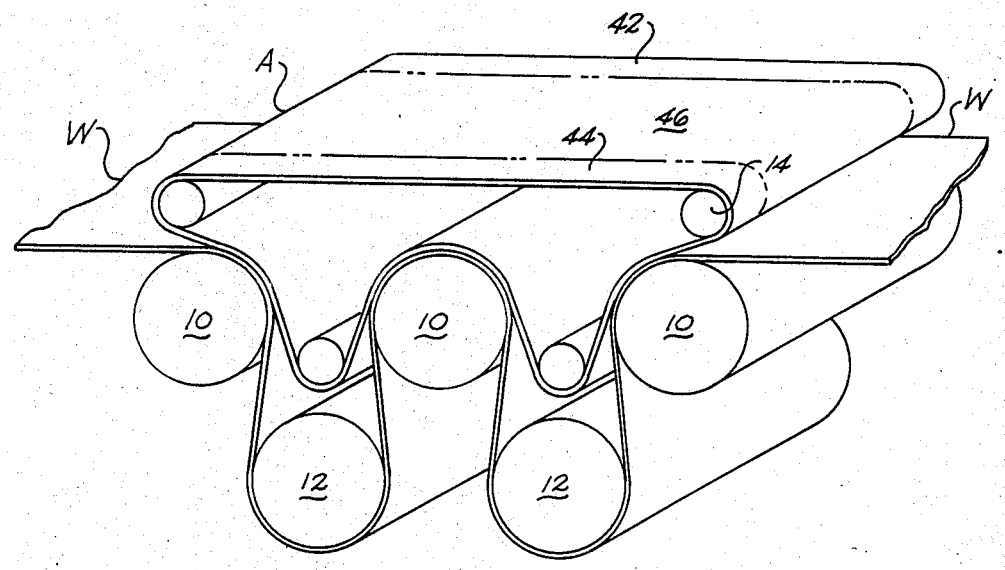
FIG. 1 is a perspective view illustrating schematically a drying section of a paper making machine having a paper web held in contact with the heating cylinders by means of a dryer belt constructed in accordance with the present invention.

Accordingly, FIG. 1 is a perspective view illustrating a paper web W passing through a dryer section of a paper making machine which includes a plurality of upper heated cylinders 10 and lower heater cylinders 12 about which the paper web travels in a serpentine manner while passing through the dryer section. The paper web W is maintained in contact against the upper heated cylinders by an endless, continuous traveling dryer belt A which travels about rollers 14. A second dryer belt is utilized in a lower position to maintain the paper web W in contact with the lower heated cylinders 12.

Figure 2:
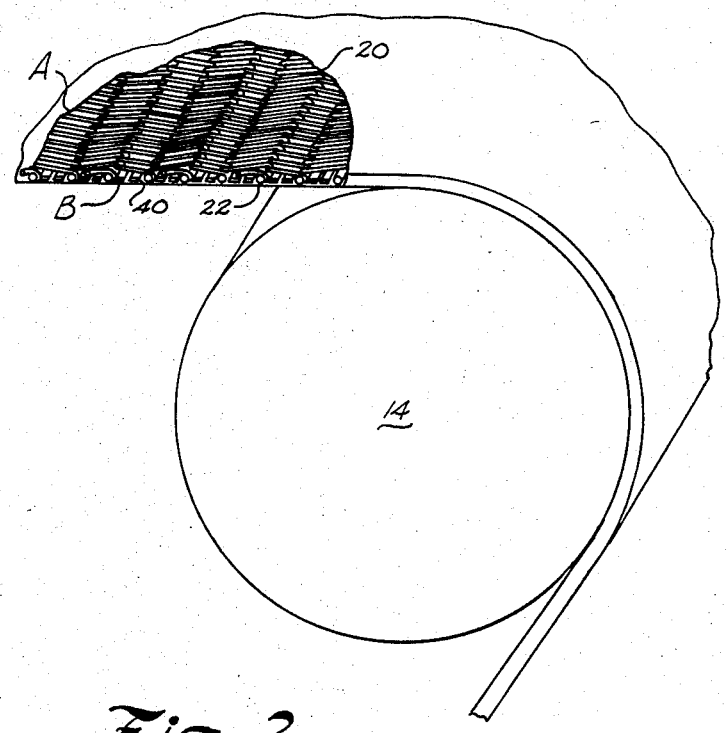
FIG. 2 is an enlarged view of the dryer section and dryer belt of FIG. 1 illustrating the details, in part, of a dryer belt constructed according to the present invention having a profiled permeability.
Figure 3:
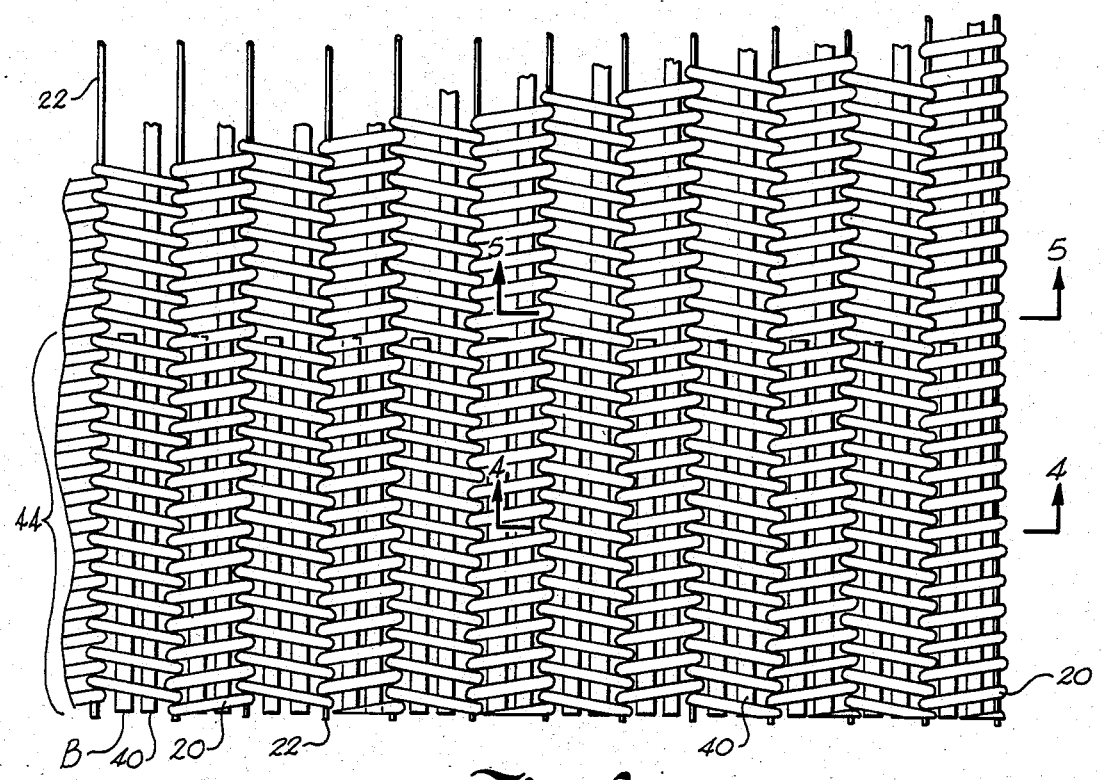
FIG. 3 is a top plan view illustrating a dryer belt fabric having a profiled permeability characteristic constructed according to the present invention.

Referring now in more detail to FIGS. 2 and 3, the fabric in the form of a dryer belt A is illustrated for use in a dryer section of a paper making machine which includes a plurality of helix strips (20) which extend crosswise in the belt across the entire width thereof. The individual helix strips are made from a suitable thermoset polymeric material such as a monofilament polyester in order to have sufficient plasticity to withstand the stress of endless travel over the belt rollers under extreme temperatures. A suitable material is type WP803 polyester made by Shakespeare Company having a 0.7 mm diameter. Pintle means for adjoining the adjacent helix strips successively together in the machine direction to provide a desired belt length is provided by pintles 22. The pintles are monofilament and extend through channels formed by the intermeshing bend portions of adjacent helix strips joining same together successively to make a dryer belt of a desired length in the machine direction which is ultimately made endless by joining the fabric end to end. Typically, the dryer belt ranges from 88 to 380 inches crosswise (width) and from 18 to 70 yards from end to end (circumference).

Figure 4:
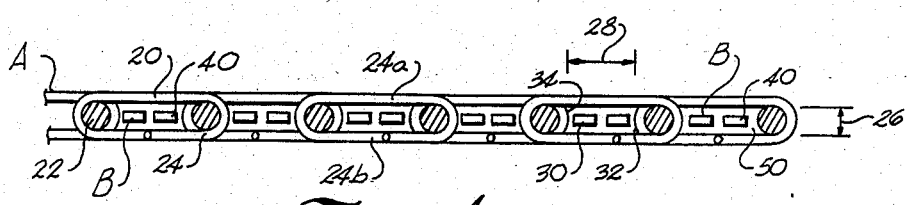
FIG. 4 is a sectional view taken along line 4—4 of FIG. 3.
Figure 5:
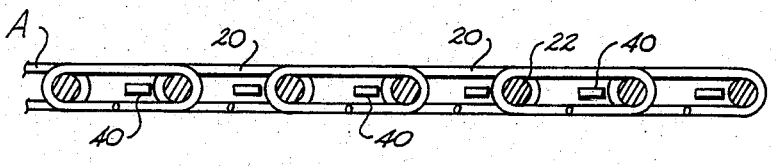
FIG. 5 is a sectional view taken along line 5—5 of FIG. 3.

As illustrated, each helix strip includes windings 24 which have an upper run **24*a* and a lower run 24*b* which are generally parallel to present a flat and smooth paper contacting surface for the fabric. An effective winding height 26 is defined between the upper and lower runs of the windings. The effective width 28 of the open winding space 30 within the windings of the helix strips is limited and defined by the protruding ends 32 and 34 of adjoining intermeshed helix strips as can best be seen in FIG. 4. An open mesh is defined in the fabric between adjacent pintle joints and runs of the windings across the length and width of the fabric. Air and/or vaporized water are transferred through the fabric mesh outwardly from the paper web as can best be seen in FIG. 3**.

The permeability of the basic helical fabric made by joining the helix strips 20 is varied and controlled by inserting a base monofilament strip element 40 across the entire width of the fabric as is more fully disclosed and appreciated in U.S. Pat. No. 4,381,612. The base monofilament strip element may be any suitable polymeric material which is compatible with the environment of the dryer section, such as nylon, polyester, or polypropylene.

In accordance with the present invention, an auxiliary edge monofilament element B is included at the opposing lateral edges of the dryer belt to provide a lateral zone 42 and 44 of reduced air permeability at each lateral edge of the dryer belt. The edge monofilament B is inserted from both sides of the dryer belt at the edges thereof inwardly toward the center, and a medial portion 46 is defined which has an air permeability characterized by the basic helical fabric construction. The basic helical fabric construction may be open or may include a base monofilament filler element 40.

When the edge monofilament filler element is used with the base monofilament filler element, the two strips of monofilament material need be dimensioned such that the thickness 50 of each strip is greater than or equal to one-half the effective height 26 of the windings. This provides the result that overlapping and sliding of the strips over one another is effectively prevented so that the permeability profile in the lateral edges is maintained with integrity. Furthermore, and as can best be seen in FIG. 4, the width of the base and edge strips, 40 and B, respectively, must be such that the total width of the side by side arrangement is less than the effective width 28 of the winding space as delimited by the protruding bends of adjacent helix strips.

It is contemplated that the lateral zones 42 and 44 which are filled with the edge filler element will comprise approximately 5 to 35 percent of the total fabric width. In one example, a dryer belt was constructed having a width of 242 inches wherein each of the lateral zones of reduced permeability were approximately 36 inches in width. A base monofilament element of 0.025 inches in thickness and 0.060 inches in width and an edge filler having a thickness of 0.025 inches and a width of 0.040 inches were utilized. The resultant permeability profile was a permeability of 250 cfm in the lateral zones 42 and 44 and a central permeability of 600 cfm in the medial zone 46.

Numerous combinations of base monofilament strips and edge monofilament strips may be had as long as the total width of the juxtaposed arrangement of the base and edge strips does not exceed the effective width of the winding space. The following are illustrated for exemplary purposes, and not for purposes of limitation. For an open helical fabric, having no base monofilament filler strip, made from 0.7 mm polyester material, the following permeability profiles are achieved: edge filler of 0.025×0.040 inches, permeability profile of 700-900-700; edge filler of 0.025×0.060, permeability profile of 600-900-600; edge filler of 0.025×0.070 inches, permeability profile of 500-900-500; edge filler of 0.025×0.090 inches, permeability profile of 400-900-400; and edge filler of 0.025×0.099, permeability profile of 300-900-300.

In another example, with a base filler element extending across the fabric width of 0.025×0.040 inches, the following permeability profiles were achieved: edge filler of 0.025×0.040 inches, permeability profile of 500-700-500; and edge filler of 0.025×0.060 inches, permeability profile of 300-700-300. In yet another example, a base monofilament element was utilized having dimensions of 0.025×0.060 inches with an edge filler of 0.8 mm diameter which provided a permeability profile of 400-600-400; and with the same base filler element and a 0.9 mm diameter edge filler, a permeability profile of 300-600-300 was provided.

Figure 6:
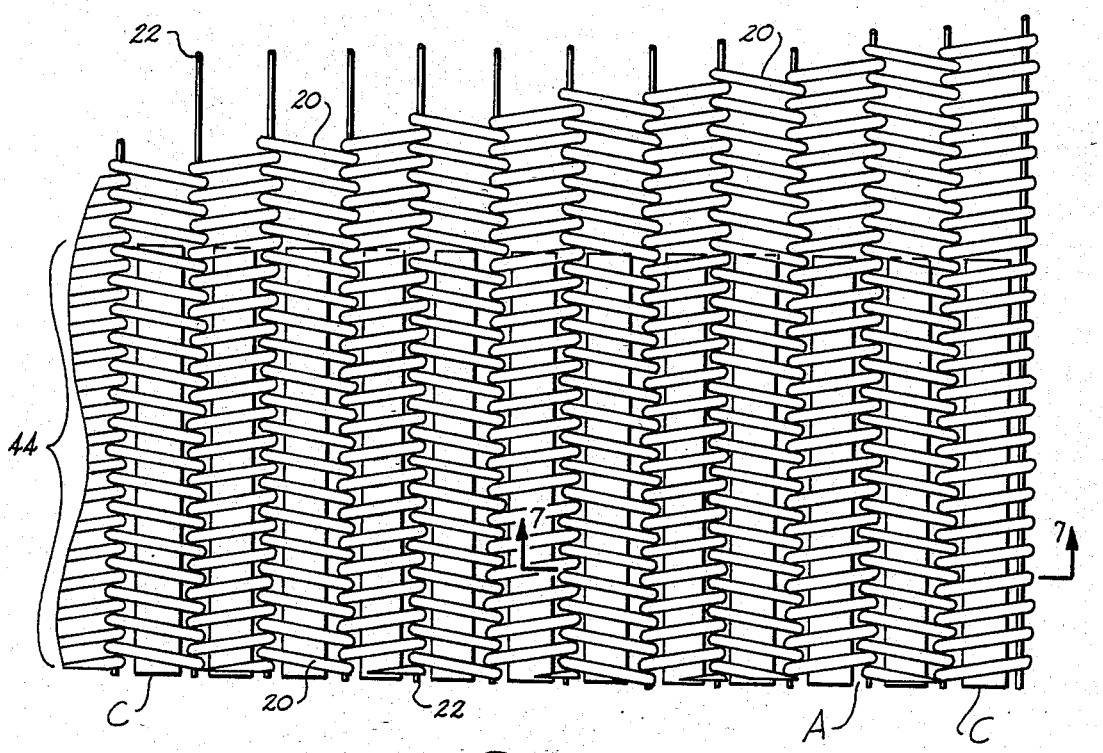
FIG. 6 is a top plan view of another embodiment of a dryer belt having a profiled permeability constructed according to the present invention.

Referring now in more detail to FIG. 6, an alternate embodiment of the present invention is illustrated wherein a contoured monofilament filler element C is illustrated as being inserted in the lateral zones 42 and 44 of reduced permeability. The contoured filler element is made in the manner as is disclosed more fully in the inventor's co-pending application, Ser. No. 502,255 filed on June 8, 1983 now U.S. Pat. No. 4,490,925 and entitled LOW PERMEABILITY SPIRAL FABRIC AND METHOD, of which the instant application is a continuation in part. The above referenced application is hereby incorporated herein by reference.

Figure 7:
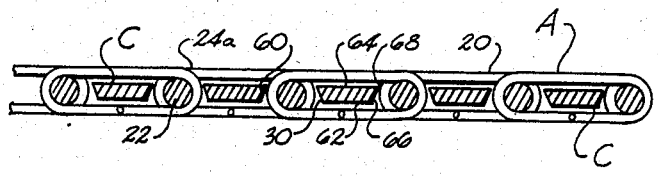
FIG. 7 is a sectional view taken along line 7—7 of FIG. 6.

As can best be seen in FIG. 7, the contoured filler element C includes contoured edge means 60 which occupies the crevice spaces defined by the top runs 24*a* of the helix strips and the intermeshing protruding bend portions of the adjacent helix strips. The monofilament edge filler C has a generally trapezoidal cross-section having a base surface 62 and a wider base surface 64. Sides 66 taper upwardly and outwardly from the base 62 to the base 64 to define the contoured edge portions 60 which extend into the crevice spaces 68 to more fully occupy the open winding space 30 and reduce the flow of air therethrough to provide space 30 and reduce the flow of air therethrough to provide a more reduced permeability profile in the lateral zones 42 and 44. A more fuller description of the contoured filler element C may be had by reference to the above pending patent application which is hereby incorporated herein by reference.

By way of an example, in one embodiment of the above described invention, a helical fabric was constructed which was open in the medial portion 46 and which included a contoured edge monofilament filler C in the lateral zones 42 and 44. The results of the permeability profile was 150-900-150. The contoured monofilament strand was dimensioned approximately 0.031×0.110 inches wherein the width of the larger base surface 64 was approximately 0.110 inches.

Referring now in more detail to the method of the present invention, the basic helical dryer fabric comprising the helix strips 20 joined together may be made in accordance with the disclosure of the above reference continuation in part application as well as that disclosed in U.S. Pat. No. 4,381,612. In accordance with the present invention, the basic helical fabric having been made, the base monofilament filler strip 40 is inserted crosswise through the windings of each helix strip. The fabric is then placed on a heat treating machine and the fabric is heat treated and thermally set. The edges of the fabric are then trimmed to provide a fabric having the desired width. The fabric is then removed from the heat treating machine and put back onto the filler machine. At that time, one edge of the fabric is filled with the edge monofilament filler B and a slight amount of glue is applied to that edge to hold the edge filler in place. An edge monofilament filler strip B is then inserted in the opposing edge of the fabric and a small amount of glue is applied to hold the second edge filler in place. The fabric is again trimmed to ensure that the desired fabric width is achieved. The edges are then coated with a layer of adhesive over about a 1-inch width and the fabric is heat sealed on its edges to provide means for permanently affixing the edge fillers in place in their side by side arrangement with the base filler, and to maintain the fabric integrity by making the base and edge filler elements and the helical fabric an integral fabric structure. In the case of utilizing a contoured edge filler strip C in the lateral zones 42 and 44 of reduced permeability, the step of inserting a base monofilament strip in the fabric is eliminated.

While a preferred embodiment of the invention has been described using specific terms, such description is for illustrative purposes only, and it is to be understood that changes and variations may be made without departing from the spirit or scope of the following claims.

What is claimed is:

1. A permeable dryer belt having a profiled permeability across the width of the belt for holding a paper web against heated cylinders in a dryer section of a papermaking machine to dry the paper web, said belt being of the type which comprises a nonwoven helical fabric having an open mesh made from a plurality of elongated helix strips extending in a crosswise direction made from a thermoset synthetic polymeric material, said helix strips including helix windings having upper and lower runs presenting a generally flat paper web contacting surface and curved bend joining the upper and lower runs; pintle means received through a channel formed by intermeshing bend portions of adjacent helix strips to successively joint the helix strips together in a machine direction to provide an endless drive belt of a desired dimension; air flow reduction means formed at opposing lateral edges of said helical belt fabric for obstructing air flow through said open mesh of said belt to define a lateral zone of reduced air permeability at each of said lateral edges; and said belt having an increased permeability through the fabric mesh of a medial portion of said belt between the lateral zones of reduced air permeability for increased drying in the center of the belt and reduced drying at said lateral zones of said belt for uniform drying of said paper web contacted thereby;

an open winding space defined within each winding of each said helix strips, said opening winding spaces being generally aligned crosswise in said fabric; each said open winding space being limited by the ends of said intermeshing bend portions of adjacent adjoining helix strips which define the effective width of said winding space; said air flow reduction means including an elongated monofilament edge filler element extending through said winding spaces of said helix strips in the lateral zones of reduced permeability terminating in free ends at the inner most edges of said lateral zones; and said monofilament edges filler means including a contoured monofilament edge filler element having a contoured portion which extends laterally over the intermeshing bend portions of adjacent helix strips into corner crevice spaces defined in the corners of said winding spaces.

2. The dryer belt of claim 1 wherein said contoured monofilament edge filler element has a generally trapezoidal cross-section with a first base surface, and tapered sides extending from said first base surface to a second surface whereby said tapered sides provide said contoured portion.

3. A permeable dryer belt for contacting and drying a paper web in a dryer section of a paper making machine which includes a plurality of helix strips having the bend portions of their windings intermeshed with one another, pintle means extending through a channel formed by the intermeshed bend portions of adjacent helix strips to join the helix strips together to make a dryer belt having a desired length dimension; said bend intermeshing portions of adjacent helix strips creating limits to the effective width of the open winding spaces of said windings; a base monofilament filler element extending across the entire width of said fabric through the windings of said helix strips, an edge monofilament filler strip extending laterally in said fabric along side said base monofilament strip across only a portion of the width of said fabric at opposing lateral edges of said fabric to define lateral zones of reduced air permeability, said base monofilament filler strip providing a desired air permeability in a central portion of said dryer belt between said lateral zones of reduced permeability;

said monofilament edge filler element and said monofilament base filler element disposed in said lateral zones of reduced permeability in a juxtaposed arrangement;

said elongated base and edge filler element arranged in said lateral reduced permeability zones having a total juxtaposed width which is less than the effective winding space width;

each said base monofilament filler strip and said edge monofilament filler strip having a thickness generally greater than one-half the height of said open winding space of said open winding space of said helix strip windings facilitating juxtaposed positioning of said filler strips in said lateral zones without overlapping for effective air flow blockage throughout said lateral zones affording uniform reduced permeability, and means affixing said base and edge monofilament strips in place in said juxtaposed arrangement throughout said lateral zones of reduced permeability to make said filler strips and helix strips integral fabric structure.

4. A nonwoven permeable dryer belt fabric having a profiled permeability characteristic comprising a plurality of elongated helix strips extending crosswise in said fabric with adjacent helix strips intermeshed and adjoining one another lengthwise in said fabric; each said helix strip including a plurality of open helix windings generally aligned across the width of said fabric, each said winding comprising a top run, a bottom run, and a bend portion adjoining said top and bottom runs; an open winding space defined within each said winding bounded by said top and bottom runs and said bend portions; crevice spaces defined in the corners of said winding spaces between the top runs and intermeshing bend portions of adjacent helix strips; elongated contoured monofilament filler means within said winding spaces extending crosswise for a predetermined distance only at the opposing lateral edges of said fabric to define a generally open medial fabric portion, said contoured monofilament filler strips including contoured edges extending laterally over said intermeshing bend portions of adjacent helix strips for occupying said corner crevice spaces and reducing the permeability of said fabric at said lateral edges to produce a desired reduction in permeability at said lateral edges relative to said open medial portion, and said contoured filler means including a generally trapezoidal cross-section defined by generally parallel surfaces wherein sides of said cross-section taper from one said surface to the other of said surfaces outwardly to provide said contoured edges.

5. A method for making a nonwoven permeable dryer belt having a profiled permeability characteristic across the width of the belt which comprises:

joining a plurality of open helix strips to one another by intermeshing bend portions of the windings of adjacent ones of said helix strips to form a continuous channel across said fabric;

inserting a pintle through said channel to join said intermeshing bend portions together;

filling the open windings of said helix strips across only a limited portion of the width of said belt at opposing lateral edges with a monofilament edge filler strip extending laterally across said limited portion of said width to reduce air flow and lower the fabric permeability at said lateral edges;

fixing the location of said monofilament edge strips at said lateral edges of said belt; and trimming the edges of said dryer belt along the length of said belt to provide a belt having a desired width.

6. The method of claim 5 including inserting a base monofilament filler strip across the entire width of said belt prior to inserting said monofilament edge filler strip; and sealing said base and edge monofilament strip together with said helix strips to make an integral fabric structure at said lateral edges.

7. The method of claim 5 including providing said monofilament edge filler strip in the form of a contoured filler element having contoured edge portions which extend over intermeshing bend portions within said winding spaces to fill the corner crevices in said winding spaces and reduce the air flow at said lateral edges.

* * * * *

Notice of Adverse Decisions in Interference

In Interference No. 102,486, involving Patent No. 4,583,302, R. W. Smith, HELICAL DRYER BELT WITH PROFILED PERMEABILITY, final judgment adverse to the patentees was rendered May 20, 1991, as to claims 5-7.

(*Official Gazette August 27, 1991*)